US009574302B2

(12) United States Patent
van Lee et al.

(10) Patent No.: US 9,574,302 B2
(45) Date of Patent: Feb. 21, 2017

(54) METHOD AND SYSTEM FOR EFFICIENT PRODUCTION OF DISSOLVING PULP IN A KRAFT MILL PRODUCING PAPER GRADE PULP WITH A CONTINUOUS TYPE DIGESTER

(71) Applicant: Pec-Tech Engineering and Construction Pte Ltd, Singapore (SG)

(72) Inventors: Richard Constantine van Lee, Pekanbaru (IN); Alagaratnam Joseph Devanesan, Singapore (SG)

(73) Assignee: RGE PTE LTD, Singapore (SG)

( * ) Notice: Subject to any disclaimer, the term of this patent is extended or adjusted under 35 U.S.C. 154(b) by 65 days.

(21) Appl. No.: 14/609,385

(22) Filed: Jan. 29, 2015

(65) Prior Publication Data

US 2015/0204013 A1 Jul. 23, 2015

Related U.S. Application Data

(62) Division of application No. 13/441,776, filed on Apr. 6, 2012, now Pat. No. 8,951,388.
(Continued)

(51) Int. Cl.
*D21C 7/00* (2006.01)
*D21C 7/06* (2006.01)
(Continued)

(52) U.S. Cl.
CPC ..... *D21C 7/06* (2013.01); *D21C 3/02* (2013.01); *D21C 7/00* (2013.01); *D21C 3/26* (2013.01)

(58) Field of Classification Search
CPC ... D21C 7/00; D21C 7/08; D21C 7/10; D21C 1/02; D21C 1/04
See application file for complete search history.

(56) References Cited

U.S. PATENT DOCUMENTS 1,931,933 A 10/1933 Nicoll
3,294,623 A 12/1966 Brinkley et al.
(Continued)

FOREIGN PATENT DOCUMENTS

CA 2077216 3/1993
CN 101333778 12/2008
(Continued)

OTHER PUBLICATIONS

Smook, Handbook for Pulp and Paper Technologists, 1992, Angus Wilde Publications, 2nd edition, chapters 8-11.*
(Continued)

*Primary Examiner* — Anthony Calandra
(74) *Attorney, Agent, or Firm* — Irell & Manella LLP

(57) ABSTRACT

A method and system for pulp manufacturing used in connection with a kraft process includes a vertical pressure vessel operated in batch mode, a single-vessel or multi-vessel continuous digester, and other equipment for further processing brown stock, such as for washing, oxygen delignification, bleaching, and drying. A feeder and conveyance system may include a high pressure feeder or direct pump system, and selectively provides fiber-containing material to the continuous digester when making lower grade pulp product and to the vertical pressure vessel when making higher grade pulp such as dissolving pulp. The vertical pressure vessel is used for pre-hydrolysis and neutralization, after which the resulting pulp is fed to the continuous digester for cooking. White liquor and black liquor from the same mill may be used for the neutralization fluids. The same continuous digester is selectively used for cooking in connection with making pulp products of different grades or quality.

11 Claims, 9 Drawing Sheets

Related U.S. Application Data

(60) Provisional application No. 61/473,712, filed on Apr. 8, 2011.

(51) Int. Cl.
*D21C 3/02* (2006.01)
*D21C 3/26* (2006.01)

(56) References Cited

U.S. PATENT DOCUMENTS

| | | | | |
|---|---|---|---|---|
| 3,322,616 | A * | 5/1967 | Hutchinson et al. | 162/238 |
| 3,429,773 | A * | 2/1969 | Richter | 162/237 |
| 3,578,554 | A * | 5/1971 | Richter | 162/19 |
| 3,579,418 | A * | 5/1971 | Ostberg | 162/18 |
| 4,123,318 | A | 10/1978 | Sherman | |
| 4,174,997 | A | 11/1979 | Richter | |
| 4,259,147 | A | 3/1981 | Gordy | |
| 4,668,340 | A | 5/1987 | Sherman | |
| 5,021,127 | A | 6/1991 | Meredith | |
| 5,066,362 | A | 11/1991 | Meredith | |
| 5,198,074 | A | 3/1993 | Villavicencio et al. | |
| 4,436,586 | A | 3/1994 | Elmore | |
| 5,326,433 | A | 7/1994 | Ryham et al. | |
| 5,413,677 | A | 5/1995 | Collins | |
| 5,415,734 | A | 5/1995 | Backlund et al. | |
| 5,589,033 | A | 12/1996 | Tikka et al. | |
| 5,788,812 | A | 8/1998 | Agar et al. | |
| 5,795,438 | A * | 8/1998 | Stromberg et al. | 162/52 |
| 5,882,477 | A | 3/1999 | Laakso | |
| 5,985,096 | A | 11/1999 | Marcoccia et al. | |
| 6,024,837 | A | 2/2000 | Laakso et al. | |
| 6,174,411 | B1 | 1/2001 | Laakso et al. | |
| 6,210,801 | B1 | 4/2001 | Luo et al. | |
| 6,569,289 | B2 | 5/2003 | Stromberg et al. | |
| 6,605,350 | B1 | 8/2003 | Sealey et al. | |
| 6,770,168 | B1 | 8/2004 | Stigsson | |
| 6,861,023 | B2 | 3/2005 | Sealey et al. | |
| 6,966,970 | B2 | 11/2005 | Snekkenes et al. | |
| 7,090,744 | B2 | 8/2006 | Sealey et al. | |
| 7,279,070 | B2 | 10/2007 | Snekkenes | |
| 7,501,043 | B2 | 3/2009 | Snekkenes et al. | |
| 7,771,565 | B2 | 8/2010 | Kirov et al. | |
| 8,734,610 | B2 | 5/2014 | Shin et al. | |
| 2004/0060673 | A1 | 4/2004 | Phillips et al. | |
| 2008/0029233 | A1 | 2/2008 | Wingerson | |
| 2011/0120663 | A1* | 5/2011 | Engstrom et al. | 162/55 |
| 2012/0211183 | A1* | 8/2012 | Leavitt et al. | 162/37 |
| 2012/0234511 | A1* | 9/2012 | Greenwood | 162/19 |
| 2012/0305209 | A1* | 12/2012 | Shin et al. | 162/237 |

FOREIGN PATENT DOCUMENTS

| | | |
|---|---|---|
| CN | 101748631 | 6/2010 |
| EP | 1 325 961 | 7/2003 |
| WO | 95/20065 | 7/1995 |
| WO | 96/07786 | 3/1996 |
| WO | 2010/046532 | 4/2010 |
| WO | 2010/104458 | 9/2010 |
| WO | 2012/158075 | 11/2012 |
| ZA | 9100917 | 8/1991 |

OTHER PUBLICATIONS

Industrial Cooking, Kai Henricson, Professor Pulping Technology, Lappeenranta University of Technology, Aug. 2004.

* cited by examiner

METHOD AND SYSTEM FOR EFFICIENT PRODUCTION OF DISSOLVING PULP IN A KRAFT MILL PRODUCING PAPER GRADE PULP WITH A CONTINUOUS TYPE DIGESTER

RELATED APPLICATION INFORMATION

This application is a Divisional of U.S. application Ser. No. 13/441,776, filed Apr. 6, 2012, and claims the benefit of U.S. Provisional Application Ser. No. 61/473,712, filed on Apr. 8, 2011, hereby incorporated by reference as if set forth fully herein.

BACKGROUND OF THE INVENTION

1) Field of the Invention

The field of the invention generally relates to pulp processing and, more specifically, to a method and system for efficient production of different types of pulp using a kraft cooking process.

2) Background

Pulp created from organic materials, such as wood chips or other vegetation, can be processed into a relatively low grade cellulose product for uses such as paper, or into a relatively high grade cellulose product for making various synthetic fabrics or products. For example, high grade pulps can potentially be used to make rayon and other synthetics and textiles, or can be used to make cellulose acetate or cellulose esters which have a variety of commercial uses. This higher grade of pulp, which is available in different levels of purity, is commonly referred to as dissolving pulp, and is generally much more expensive than paper grade pulp.

A number of chemical and mechanical methods exist for processing organic materials in order to manufacture pulp products such as paper. Some of the basic steps include preparing the raw material (e.g., debarking and chipping), separating the wood fibers by mechanical or chemical means (e.g., grinding, refining or cooking) to separate the lignin and extractives from cellulose of the wood fibers, removing coloring agents by bleaching, and forming the resulting processed pulp into paper or other products. In addition to and in connection with pulp and paper manufacturing, pulp mills also typically have facilities to produce and reclaim chemical agents, collect and process by-products to produce energy, and remove and treat wastes to minimize environmental impact.

A well known process for manufacturing pulp is known as the kraft process, which has been around for many decades. In a typical kraft process, organic materials are treated with chemicals and heat in order to liberate lignins and purify the cellulose within the organic materials. The organic material may be treated with an aqueous mixture of sodium hydroxide and sodium sulfide, known as white liquor. The treatment breaks the linkage between lignin and cellulose, and degrades most of lignin and a portion of hemicellulose macromolecules into fragments that are soluble in strongly basic solutions. This process of liberating lignin from surrounding cellulose is known as delignification. The soluble portion is thereafter separated from the cellulose pulp.

When making dissolving grade pulp, a goal is to achieve a high cellulose purity or quality. Pulp quality can be evaluated by several parameters. For example, the percentage of alpha cellulose content expresses the relative purity of the processed pulp. The alpha cellulose content can be estimated and calculated based on the pulp solubility (e.g., S10 and S18 factors). The degrees of delignification and cellulose degradation are measured by Kappa Number ("KN") and pulp viscosity respectively. A higher pulp viscosity indicates longer cellulose chain length and lesser degradation.

When making dissolving pulp, it is common to perform pre-hydrolysis and neutralization steps on the pulp prior to cooking. Pre-hydrolysis is generally performed to remove hemicellulose, to lesser extent lignins. Pre-hydrolysis is generally performed utilizing hot water, steam, acid (usually sulphuric) or any combination of those. After pre-hydrolysis, the organic material is neutralized with a neutralization liquor (typically alkali media) such as caustic, white liquor, weak black liquor or any combination of those. After neutralization, the organic material is cooked in a digester along with various cooking liquors in order to further dissolve the hemicellulose and lignins. The resulting cooked pulp, known as brownstock, may be collected, washed, and bleached by downstream processes in order to produce pulp of desired characteristics.

When making paper grade pulp, it is not necessary to carry out the same type of pre-hydrolysis and neutralization as carried when making dissolving pulp. The cooking stage for paper grade pulp is generally similar to the cooking process for making dissolving grade pulp. The process of making paper grade pulp generally has a higher yield than that used for dissolving grade pulp, because when in the absence of pre-hydrolysis and neutralization significantly less hemicellulose is removed.

There are two basic types of digesters used for pulp production. The first type is referred to as a batch digester, which is a type of vertical pressure vessel generally used to perform sequential processing steps on the pulp. When making dissolving pulp, the same digester or vertical pressure vessel is first used for pre-hydrolysis and neutralization, and then for kraft cooking. The second type of digester is referred to as a continuous digester, which generally includes all or several of the processing stages through the completion of cooking at different levels of a single unit. When making dissolving pulp in a continuous digester, the pre-hydrolysis may be carried out at an upper portion of the continuous digester, and the cooking in a lower portion of the continuous digester.

Using a single-vessel continuous digester to make dissolving pulp may experience significant problems. For example, scaling or gunking eventually occurs due to the mixing of hydrolysate and kraft liquors. When this happens, the system must be shut down and cleaned. Also, it may be more difficult or impossible to separately recover hydrolysate as a by-product. In an attempt to overcome these problems, two-vessel continuous digesters have been developed, as exemplified for example by U.S. Pat. Nos. 4,436,586, 4,174,997 and 4,668,340. These systems are sometimes advertised as having the ability to maintain a cleaner separation between the acidic liquors in the pre-hydrolysis system and the caustic liquors in the kraft system. The two vessels of a continuous digester work in tandem to provide a continuous process whereby pre-steamed wood chips or similar matter is deposited into the top of the first vessel, are exposed to pre-hydrolysis as they pass downwardly in the first vessel until they are ultimately discharged from the bottom of that vessel, delivered to the top of the second vessel, and then exposed to a cooking process as they pass downwardly through the second vessel until they are ultimately discharged from the bottom of that vessel.

Many pulp facilities which focus on producing paper grade pulp employ single-vessel continuous digesters. These facilities are not well suited to making dissolving pulp. Using a single-vessel continuous digester to produce dissolving pulp would, as noted, result in scaling and gunking that would eventually require a shutdown of the system for cleaning.

There exists a need for pulp production system and method the permits greater flexibility, increased efficiency, or other benefits, and which generally may avoid the need to periodically shut down the facilities for cleaning resulting from reactions occurring during the manufacture of dissolving grade pulp.

SUMMARY OF THE INVENTION

In one aspect, an improved method and system for pulp manufacturing is provided in which pulps of different quality can be selectively produced using shared continuous kraft cooking equipment and, when producing dissolving pulp, additional pre-hydrolysis equipment. The method and system may be employed to economically retrofit an existing paper grade pulp mill with an additional pressure vessel system operated in batch mode along with certain supporting equipment in order to allow the mill to selectively produce either paper grade pulp or dissolving pulp in an efficient manner.

According to one or more embodiments, a method and system for pulp manufacturing used in connection with a kraft process includes a continuous digester along with downstream equipment for processing the resulting brown stock, which may include, among other things, equipment and processes for washing the brownstock and treating it by oxygen delignification, bleaching the delignified pulp, and drying the pulp. To make paper grade or generally lower quality pulp, wood chips or other organic fiber-containing materials may be fed into the continuous digester for cooking towards the start of the process. To make dissolving grade or generally higher quality pulp, wood chips of other organic fiber-containing materials may first be fed into a vertical pressure vessel operated in batch mode for performing pre-hydrolysis, after which the resulting hydrolyzed chips may be fed into the continuous digester for cooking.

In one aspect, shared equipment can be utilized to selectively produce either paper grade or dissolving grade pulp, depending upon whether the vertical pressure vessel is employed for batch-mode pre-hydrolysis and neutralization, and subject to any appropriate modifications or optimizations of cooking parameters and subsequent downstream steps. This can substantially reduce costs and provide significant production flexibility.

In another aspect, a paper grade pulp processing facility employing a continuous digester may be modified or retrofit with an upstream vertical pressure vessel system operated in a batch mode (along with other supporting equipment as may be necessary) in order to allow the entire combined system to produce dissolving pulp, subject to any appropriate modifications or optimizations of cooking parameters and subsequent downstream steps. Among other things, this approach may advantageously permit an existing paper grade pulp processing facility to be utilized to produce higher-grade more expensive dissolving pulp, can save costs, and may provide significant production flexibility. It may further allow white liquor and black liquor locally generated at the same mill (in connection with, e.g., operation of a white liquor generating process such as in a recausticizing plant or facility, or in connection with washing activities) to be utilized as neutralization fluids when making dissolving pulp, potentially avoiding the need to use an external source of such liquors.

According to yet another aspect, a system and method for producing dissolving pulp is provided by use of a vertical pressure vessel for performing pre-hydrolysis and neutralization in a batch mode, followed by a continuous digester for performing kraft cooking. After cooking, further downstream steps may be performed on the resulting brownstock including, for example, washing the brownstock and treating it by oxygen delignification, bleaching the delignified pulp, and drying the pulp.

Embodiments of the invention are well suited for retrofitting paper pulp mills to provide an additional capability to produce dissolving pulp. A paper pulp mill, once retrofitted, can, if desired, be employed to produce exclusively dissolving pulp.

Further embodiments, alternatives and variations are also described herein or illustrated in the accompanying figures.

DETAILED DESCRIPTION OF PREFERRED EMBODIMENTS

According to one or more embodiments, a method and system is provided for retrofitting or modifying an existing paper grade pulp mill utilizing a continuous digester to allow the mill to selectively produce either paper grade pulp or dissolving pulp in an economic manner. An example of an embodiment includes a vertical pressure vessel operable in batch mode added upstream from the continuous digester. The chip feeding system for the continuous digester may be modified to divert the normal flow of wood chips or other fiber-containing material from the normal path to the continuous digester instead to the vertical pressure vessel, whereupon pre-hydrolysis and neutralization are carried out in a batch mode. Afterwards, the pre-treated wood chips or other fiber-containing material may be stored in a storage tank to facilitate a steady flow of material to the continuous digester when making dissolving pulp according to a kraft cooking process. The conventional steps for washing, screening, delignifying, and drying the pulp may be subsequently carried out. When it is desired to return to making paper grade pulp, the system may be readily operated to return the flow of fiber-containing material to the path towards the continuous digester, bypassing the vertical pressure vessel equipment.

In various embodiments, a method and system for selectively producing pulp of different grades or qualities involves a configuration in which a vertical pressure vessel, operated in a batch mode, is disposed upstream from a continuous digester (either single-vessel or multiple-vessel), wherein the continuous digester is operable to selectively carry out kraft cooking of paper grade pulp or dissolving pulp. The vertical pressure vessel is used for pre-hydrolysis and neutralization when the system is producing dissolving pulp, and preferably has a capacity sufficient to ensure a continuous supply of pre-hydrolyzed fiber-containing material to the continuous digester. The vertical pressure vessel generally need not be utilized in connection with making paper grade pulp. A feeder and pre-treatment system may be employed to selectively supply organic fiber-containing material to the vertical pressure vessel when making dissolving pulp and to the continuous digester when making paper grade pulp.

In a preferred embodiment, a storage tank is interposed between the batch type vertical pressure vessel and the continuous digester for storing chips that have been subject to pre-hydrolysis and neutralization. Treated chips stored in the storage tank may be conveyed, after pre-hydrolysis and neutralization either directly to the continuous digester or its feeding system in case of a single-vessel system or to an impregnation vessel or first of two vessels in case of a dual-vessel system.

The invention in its various embodiments may be better understood by comparison with conventional systems and processes as currently practiced in the art.

Figure 1:
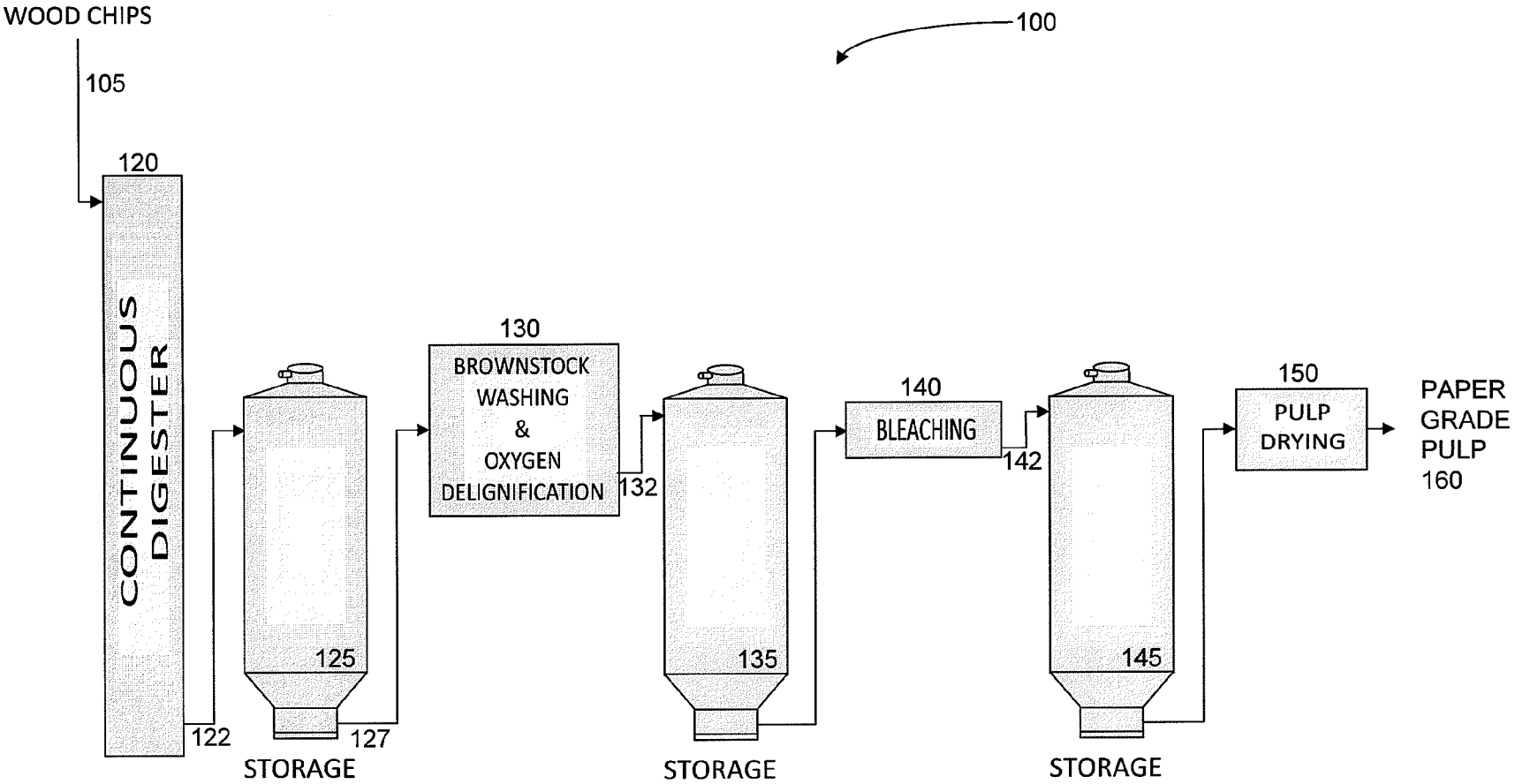
FIG. 1 (PRIOR ART)
FIG. 1 is a generalized system diagram of one conventional technique for production of paper grade pulp, as generally known in the art.

FIG. 1 shows a flow diagram of a conventional system 100 and technique for making paper grade pulp, as known in the art. The system 100 involves feeding wood chips (or other organic fiber-containing raw materials) 105, after pre-treatment such as steaming or other preparatory processing, along with various liquors or alkaline solutions into a continuous digester 120 of conventional construction, such as, merely by way of example and not limitation, a Kamyr® continuous digester made or sold by Andritz-Ahlstrom Inc. of Glens Falls, N.Y., or a continuous digester of the type made or sold by Metso Corporation of Karlstad, Sweden, or any other type of continuous digester. The continuous digester 120 may be single-vessel or dual-vessel, and generally may have several zones for performing different treatments on the wood chips or other organic material as they pass down from the top of the continuous digester 120, where they are introduced, to the bottom of the continuous digester 120, where they are withdrawn as brownstock, i.e., a brown solid cellulosic pulp, for eventually making paper grade or similar pulp.

After cooking, the brownstock 122 may be withdrawn from the continuous digester 120 and temporarily stored in a storage tank 125, and later screened, washed and further treated in a washing and oxygen delignification process 130. Screening helps separate the pulp from shives (bundles of wood fibers), knots (uncooked chips), dirt and other debris. The brown stock may then be subject to one or more serial washing stages to separate the spent cooking liquors and dissolved materials from the cellulose fibers. The cleaned brown stock pulp after washing may then be blended with oxidized white liquor and fed into a reaction vessel (i.e., subjected to oxygen delignification) to further separate lignin. The purified pulp from the reaction vessel is then washed several times in a second washing and separation unit, whereupon it may be stored if necessary in a downstream storage tank 135.

The resulting purified brown pulp 132 may continue to a downstream bleaching unit 140 for further delignification and brightening (e.g., removal of the generated chromophoric substances). After bleaching, the treated pulp 142 may be temporarily stored in another downstream storage tank 145, after which it may be extracted and provided to a pulp drying station 150. After drying the resultant pulp 160 may be formed into bales of paper grade quality or into other similar pulp products.

Figure 3:
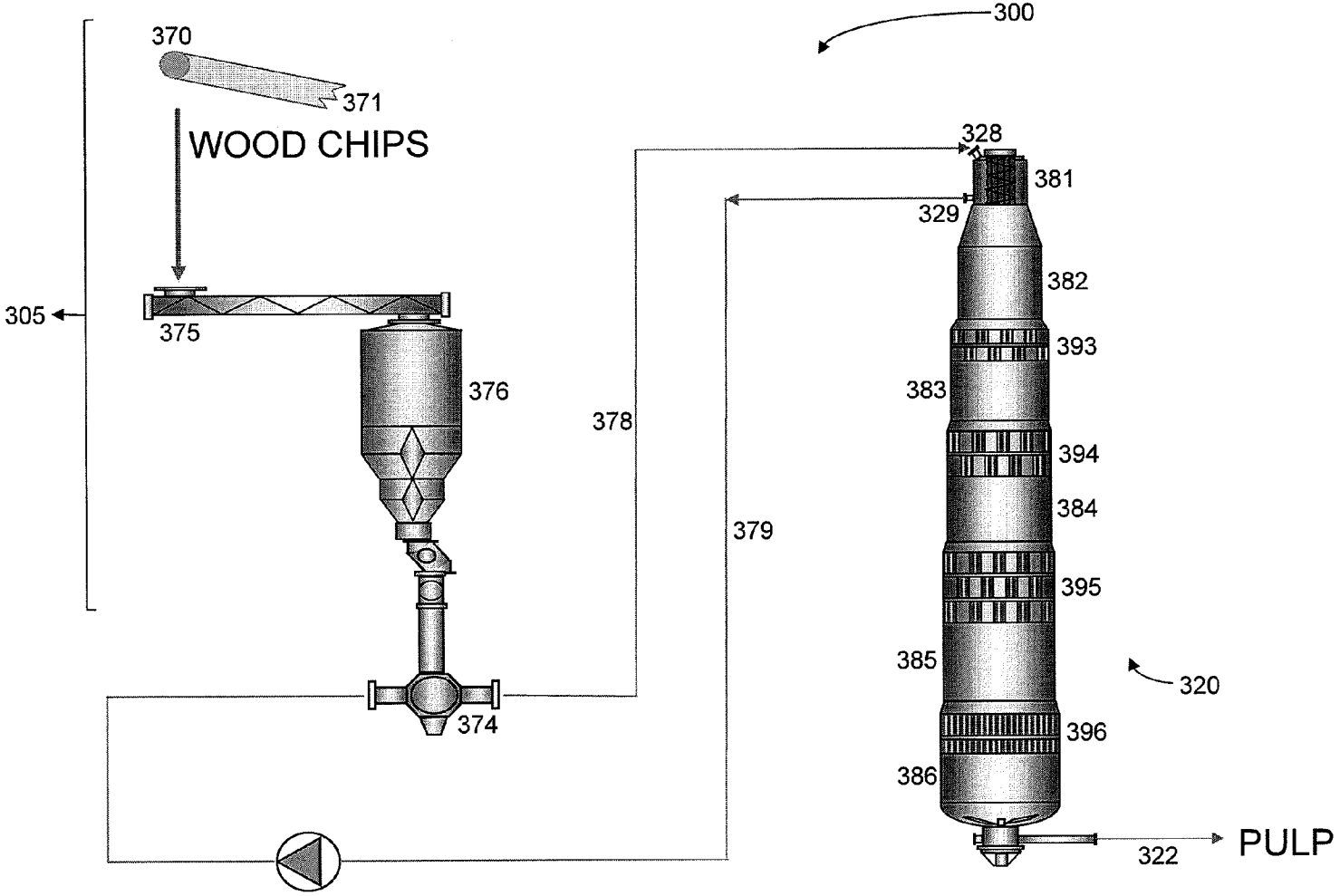
FIG. 3 (PRIOR ART)
FIG. 3 is a more detailed diagram in general accordance with the overall system of FIG. 1, illustrating a portion of a conventional system involving pre-treatment of wood chips and their use in a continuous digester in connection with a process for making paper grade pulp as known in the art.

Further details of a typical implementation of the conventional system 100 of FIG. 1 are illustrated in FIG. 3, which shows the initial portion 300 of the system involving pre-treatment of wood chips up through their treatment in a continuous digester. As illustrated in FIG. 3, a feed system 305 may include, among other things, a conveyor 370, a horizontal air-lock feeder (e.g., a screw conveyor) 375, a chip bin or chip silo 376, and high pressure feeder 374. In a typical process, wood chips or other similar organic fiber-containing matter are fed from chip piles through series of belt conveyors 370, and deposited (e.g., through a chute) to the horizontal air-lock feeder 375, and from there to chip bin or chip silo 376 in which they are subjected to steaming for heating and air removal. The chip silo 376 may be followed by a chip meter, one or more horizontal steaming vessels (typically no longer used by modern systems), a low pressure feeder, a chip chute and high pressure feeder 374 which may further expose the pre-treated wood chips to one or more liquors. Collectively the feed system 305 may serve to de-aerate, heat, and pressurize the wood chips, and also expose them to initial cooking liquors in preparation for the cooking phase.

The pre-treated wood chips may then be transferred as needed to a continuous digester 320, which is usually constructed as a tall cylindrical vessel, via the high-pressure feeder 374. The high pressure feeder 374 feeds the mixture to an inlet 328 at the top of the continuous digester 320, which may be outfitted with, for example, a separator 381 which may be an inverted top separator or other type of separator. As the chip mixture is fed to the continuous digester 320, white liquor or other cooking liquors (depending upon the particular process) may be added in the proximity of the chips to form a slurry. If the continuous digester 320 is a hydraulic type, the slurry of chips and liquor may, for example, be introduced to a top separator which typically includes a spiral screw-type conveyance, which removes excess liquid from the slurry as the slurry is conveyed downwards towards the adjacent chamber of the continuous digester 320. If the continuous digester 320 is a vapor-phase type, the separator 381 may be an inverted top separator which includes a gas-pressurized space where the slurry of chips and liquor are introduced. The inverted top separator may remove excess liquid from the slurry as it transfers the mixture upwards through a helical screw-type conveyance and discharges the slurry so that it descends to the next chamber of the continuous digester 320.

Excess liquor removed by the separator 381 is commonly returned to the high pressure feeder 374 for transfer of chips to digester. The excess liquor is re-circulated to the high pressure feeder 374 via pump 377 and used to form the initial chip mixture that is transferred by high pressure feeder 374 to the top inlet 328 of the continuous digester 320.

The slurry of chips and liquor moves downward at a controlled rate from the top of the continuous digester 320 to the bottom. The continuous digester 320 is divided into a series of chambers, in this example including chambers 382, 383, 384, 385, 386, through which the slurry eventually passes in order to complete the cycle of cooking processes. Between each pair of chambers is typically located a screen, such as screens 393, 394, 395 and 396, along with a pump, heater, and return conduit (not expressly shown in FIG. 3). The screens 393, 394, 395 and 396 generally retain the slurry material as the liquor is extracted, modified (by augmentation or removal of liquor), pressurized, heated, and returned to the continuous digester 320 in proximity of the screen. In order to relieve the compression or compaction of the chip column near each screen, it is typical for the diameter of the continuous digester 320 to expand modestly in the area around or just below the screen, hence resulting in a series of chambers 382, 383, 384, 385, and 386 that gradually expand radially in size from the top of the continuous digester 320 to the bottom, as illustrated in FIG. 3.

The slurry mixture is impregnated, cooked (in an upper cooking zone and a lower cooking zone) and washed in the continuous digester 320 in a series of stages corresponding to the different chambers 382, 383, 384, 385, and 386 of the continuous digester 320. Depending in part upon the selected temperature for the heating of the cooking liquors and control of the downward flow through modulating the extraction rate of slurry or recirculation of liquid mixture, the time(s) and temperature(s) at which the slurry is cooked can be controlled. The ranges of times and temperatures for cooking slurry to achieve a brownstock suitable for paper grade pulp is well known in the art, although individual mills often have their own variations and adjustments to the overall cooking process.

After the slurry is cooked and washed, the resulting pulp brownstock is extracted through a blow line 322 or other means disposed at the bottom of the continuous digester 320. The brownstock is then conveyed downstream for further processing as previously described in connection with FIG. 1.

While many pulp mills are devoted to the production of paper grade pulp, it is also desirable in a number of applications, such as the manufacture of synthetic materials or cellulose derivatives such as acetate, to have pulp of relatively high purity or quality that has substantially reduced amounts of hemicelluloses and higher relative percentage of cellulose, known as dissolving pulp. Pulp quality can be evaluated by several parameters. For example, the percentage of alpha cellulose content, which signifies the relative purity of the processed pulp, is reflected in the pulp solubility as may be expressed by S10 or S18 factors, as understood in the industry. The degrees of delignification and cellulose degradation are reflected by Kappa Number ("KN") and pulp viscosity respectively. A higher pulp viscosity indicates longer cellulose chain length and lesser degradation. Standard 236 om-99 of the Technical Association of Pulp and Paper Industry (TAPPI) specifies a standard method for determining the Kappa number of pulp, which indicates the lignin content or bleachability of pulp.

In the conventional system illustrated in FIGS. 1 and 3, it is difficult to manufacture dissolving grade pulp. Using a single-vessel continuous digester such as illustrated in FIGS. 1 and 3 to make dissolving pulp may result in significant problems. In order to make dissolving grade pulp, the commonly used kraft process generally involves pre-hydrolysis prior to cooking. With a single-vessel continuous digester, the pre-hydrolysis must be carried out in one of the upper chambers of the digester. Since the chambers cannot be completely isolated from one another, the hydrolysate from the pre-hydrolysis stage and cooking liquors from later stages intermix and cause reactions which ultimately lead to scaling or gunking on the interior of the continuous digester or in the supporting piping or reservoirs. When this happens, as it inevitably does from time to time, the system must be shut down and cleaned thus entailing significant expense and causing a temporary loss of operation. Another problem with using a single-vessel continuous digester is that it may be more difficult or impossible to separately recover hydrolysate as a by-product.

In an attempt to overcome these problems, two-vessel continuous digesters have been developed. These systems are sometimes advertised as having the ability to maintain a cleaner separation between the acidic liquors from the pre-hydrolysis stage and the caustic liquors from the kraft cooking stage. As noted previously, the two vessels of a continuous digester work in tandem to provide a continuous process whereby pre-steamed wood chips or similar matter is deposited into the top of the first vessel, are exposed to pre-hydrolysis as they pass downwardly in the first vessel until they are ultimately discharged from the bottom of that vessel, delivered to the top of the second vessel, and then exposed to a cooking process as they pass downwardly through the second vessel until they are ultimately discharged from the bottom of that vessel. However, the two-vessel continuous digester design may still suffer from unintended inter-mixing of hydrolysate and kraft cooking liquors which in turn can lead to buildup of undesired scales or matter in the interior of the continuous digester. A dual-vessel continuous digester can also be significantly more expensive than a single-vessel continuous digester, although it allows for much larger capacity of pulp to be produced where single vessel size does not allow for proper process control. On the other hand, most of the older and smaller capacity (for example, below 2000 ADt/d) pulp mills currently using a single-vessel digester do not have the benefits of the two-vessel structure of the more complex two-vessel digester design. Since most mills making paper grade pulp do not have a need for pre-hydrolysis, they commonly utilize a less expensive single-vessel continuous digester, the design of which is more suited for making paper grade pulp.

Figure 2:
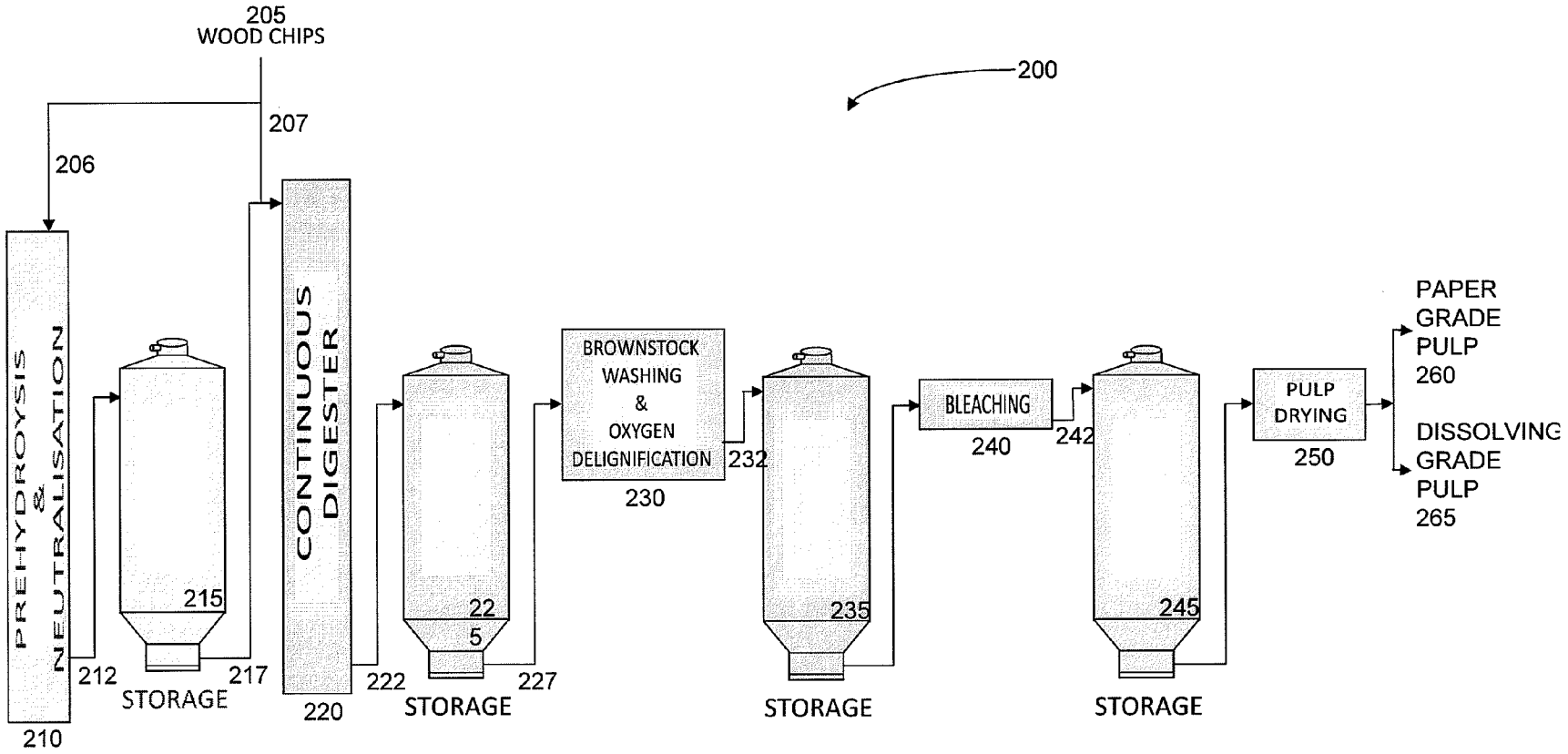
FIG. 2 is a generalized system diagram of a dual-function pulp production facility for making different grades of pulp, in accordance with one embodiment as disclosed herein.

According to one or more embodiments as disclosed herein, a method and system for modifying or retrofitting an existing paper grade pulp mill to allow production of dissolving pulp, or for selectively producing pulp of different grades or qualities, involves the use of a configuration in which a vertical pressure vessel operated in a batch mode is disposed upstream from a continuous digester as illustrated in the example of FIG. 2. In FIG. 2, a system 200 for producing pulp involves selectively feeding comminuted cellulose fiber 205, such as wood chips or other organic fiber-containing raw materials, and appropriate liquors or alkaline solutions to either (i) a vertical pressure vessel system 210, which may comprise one or more vessels similar in nature to batch digesters, to start the process for making dissolving pulp, or (ii) a continuous digester 220 to start the process for making paper grade pulp.

When making dissolving grade pulp, the comminuted cellulose fiber 205 is diverted from its standard entry point 207 into the paper pulp kraft continuous cooking process, whether chip bin, chip silo, buffer tube, or other means, and delivered to the vertical pressure vessel system 210 of the combined system 200. The vertical pressure vessel system 210 is operated in a batch mode so as to subject the wood chips or other material 206 to pre-hydrolysis and neutralization as commonly performed when making dissolving pulp in an entirely batch system. After completing the pre-hydrolysis and neutralization processes, the chips may be moved from the vertical pressure vessel system 210 to a storage tank 215, and subsequently provided to a continuous digester 220 whereupon kraft cooking may be carried out according to temperatures, time settings, and other parameters as would be necessary to produce a brownstock for dissolving pulp. Preferably, the total capacity of the vertical pressure vessel system 210, and hence the number of pressure vessels, will match the existing capacity of the mill and specifically its recovery boiler as solids amounts per ton of pulp differ between paper grade pulp and dissolving pulp. For example, with eucalyptus the amount of solids to the recovery boiler may generally amount to 1.45 to 1.5 t DS/ADt (tons dry solid per air dry tonne) of pulp for paper grade pulp, and for dissolving pulp may generally amount to 2.34 to 2.4 t DS/ADt. Thus, a kraft pulp mill producing 1000 ADt of paper grade pulp per day will feature a recovery boiler with a capacity of approximately 1500 t DS/d, and to match the recovery boiler capacity, the vertical pressure vessel system 210 capacity would preferably be selected so that the mill will produce approximately 625 ADt/d of dissolving pulp, assuming a factor of 2.4 t DS/ADt is used.

Although FIG. 2 illustrates a situation where pre-hydrolyzed chips or other fiber-containing material are temporarily stored in a storage tank 215, in other embodiments, it may be possible to supply the continuous digester 220 directly from the vertical pressure vessel system 210 using, e.g., one or more valves to switch between different pressure vessels in the vertical pressure vessel system 210, thereby ensuring a continuous supply of material to the continuous digester 220. In such an embodiment, it would be desirable for the vessels of the vertical pressure vessel system 210 to have sufficient capacity to supply the continuous digester 220 without interruption.

Alternatively, in embodiments using a storage tank 215, the continuous digester 220 may be selectively fed from the storage tank 215 or directly from one or more vessels of the vertical pressure vessel system 210, using one or more valves to control the input to the continuous digester 220. In this case, a smaller storage tank 215 may be required.

When making paper grade pulp, the wood chips or other material 207 provided to the continuous digester 220 may be subject to steaming and other pre-treatment as previously described and conventionally practiced in connection with making paper grade pulp. Once provided to the continuous digester 220, cooking may be carried out according to temperatures, time settings, and other parameters as would be necessary to produce a brownstock for paper grade pulp.

The continuous digester 220 may be of any type of construction, and by way of example and not limitation, may be a Kamyr® continuous digester made or sold by Andritz-Ahlstrom Inc. of Glens Falls, N.Y., or a Lo-Solids® continuous digester made or sold by Andritz AG of Austria, or a continuous digester of the type made or sold by Metso Corporation of Karlstad, Sweden, or any other type of continuous digester. Among other possibilities, the continuous digester 220 may be single-vessel or multi-vessel (e.g., dual-vessel), and may be hydraulic or vapor-phase in nature. As noted before, the continuous digester 220 generally has a number of zones or chambers for performing different treatments on the wood chips or other organic material as they pass down from the top of the continuous digester 220, where they are introduced, to the bottom of the continuous digester 220, where they are withdrawn as brownstock, i.e., a brown solid cellulosic pulp, for eventually making either paper grade pulp or dissolving pulp as the case may be.

Whether making paper grade pulp or dissolving pulp, after cooking the resulting brownstock 222 is withdrawn from the continuous digester 220 and temporarily stored in a storage tank 225. From there, the brownstock may be screened, washed and further treated in a washing and oxygen delignification process 230 as previously described. Screening helps separate the pulp from shives (bundles of wood fibers), knots (uncooked chips), dirt and other debris. Washing may be carried out by any means, such as for example, the use of horizontal belt washers, rotary drum washers, vacuum filters, wash presses, compaction baffle filters, atmospheric diffusers or pressure diffusers, among other means. The cleaned brown stock pulp after washing may then be blended with white liquor and fed into a reaction vessel. The purified pulp from the reaction vessel is then generally washed several times in a second washing and separation unit, whereupon it may be stored if necessary in a downstream storage tank 235.

The resulting purified brown pulp 232 may continue to a downstream bleaching unit 240 for further delignification and brightening to remove generated chromophoric substances. After bleaching, the treated pulp 242 may be temporarily stored in another downstream storage tank 245, after which it may be extracted and provided to a pulp drying station 250. After drying the resultant paper grade pulp 260 or dissolving pulp 265 may be formed into bales or other similar pulp products.

Although both paper grade pulp and dissolving pulp will be exposed to similar steps of screening, washing, delignification, bleaching, and drying, these steps may be optimized or tuned to take account of the different characteristics of paper grade pulp (or brownstock) and dissolving pulp (or brownstock). For example, dissolving pulp is generally cooked in a manner so that it achieves a lower Kappa number than paper grade pulp, and as a result the bleaching conditions for dissolving pulp will be much milder with less chemical consumption per ADt (air dry tonne).

Figure 4:
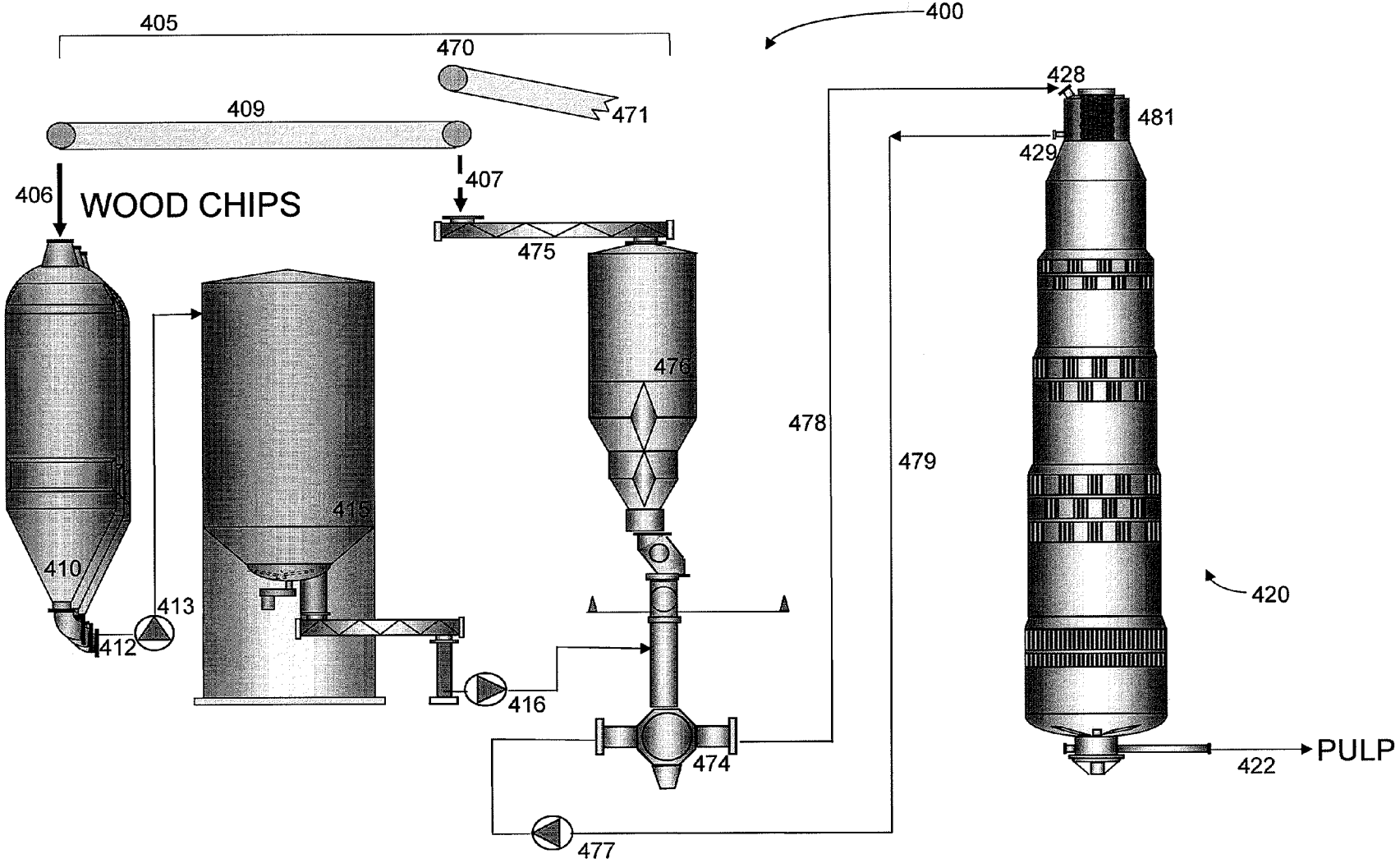
FIG. 4 is a more detailed diagram of a portion of a dual-function pulp production facility, in general accordance with FIG. 2, for making different grades of pulp and as may be used to retrofit an existing paper mill employing a continuous digester system, according to an embodiment as disclosed herein.

Further details of the front-end of one possible embodiment for implementing the system 200 shown in FIG. 2 are shown in FIG. 4, which shows the feeding of the wood chips up through their treatment in a continuous digester. As illustrated in FIG. 4, a feeder and pre-treatment system 405 may include, among other things, one or more conveyors 470, 409, a horizontal air-lock feeder (e.g., a screw conveyor) 475, a chip bin or chip silo 476, chip meter, low pressure feeder and high pressure feeder 474 or series of pumps. Wood chips or other similar organic fiber-containing matter are fed from chip piles 471 to a first conveyor or conveyance system 470, and deposited onto a reversibly controllable intermediate conveyor or conveyance system 409. The intermediate conveyor or conveyance system 409 can be operated in one direction to deposit the wood chips or other organic fiber-containing material (e.g., through a chute) in a vertical pressure vessel system 410 when the system is making dissolving grade pulp, and in the opposite direction to deposit the wood chips or other organic fiber-containing material to the horizontal air-lock feeder 475 when the system is making paper grade pulp. As noted earlier, the vertical pressure vessel system 410 may comprise one or more batch mode reaction vessels generally similar to a batch digester or other pressurized reaction vessel(s).

When the system is making paper grade pulp, the operation is similar to as described in connection with FIGS. 1 and 3. Specifically, after the wood chips or similar material are deposited from the intermediate conveyor or conveyance system 409 into the air-lock feeder 475, they are, as described before, subject to pressurized steaming in advance of cooking. The wood chips are then transferred to the chip bin or chip silo 476 in which they may experience steaming for the purpose of heating and air removal. The chip bin or silo 476 is connected via a chip meter and low pressure feeder to the high pressure feeder 474 may further expose the pre-treated wood chips to one or more liquors. Collectively the feed system 405 may, among other purposes, serve to de-aerate, heat, and pressurize the wood chips, and also expose them to initial cooking liquors in preparation for the cooking phase when making paper grade pulp.

The pre-treated wood chips are then transferred as needed to the continuous digester 420, with the high pressure feeder 474 feeding the mixture of chip material and liquors to an inlet 428 at the top of the continuous digester 420, as previously described in connection with FIG. 3. As before, the continuous digester 420 may be outfitted with, for example, a separator 481 which may be an inverted top separator or other type of separator, and may have a series of chambers or zones from top to bottom through which different cycles of the cooking process are sequentially carried out. The pre-treated wood chips are then cooked in the continuous digester 420 according to any relevant technique for making a brownstock for paper grade pulp.

When the system is making dissolving grade pulp, the wood chips or similar material are deposited in a vertical pressure vessel system 410 (e.g. one or more pressurized vessels) for performing pre-hydrolysis and neutralization in a batch mode. In a preferred embodiment, the wood chips of similar material are packed in the vessels of the vertical pressure vessel system 410 using low pressure (LP-) steam, and then heated using both LP- and medium pressure (MP-) steam to a suitable temperature of, e.g., 165° C. and maintained at the selected temperature. Other means may also be used for packing and heating the wood chips or similar material, and other temperatures may be selected depending upon the nature of the process and the pulp material.

After pre-hydrolysis, the vessel contents of the vertical pressure vessel system 410 may be at a relatively low pH of, e.g., approximately 2. Following pre-hydrolysis, a neutralization step commences through the addition of various alkaline fluids or liquors, such as a white liquor (which is preferably generated in the mill's recausticizing plant and thus may not require an external source) and a black liquor (which is preferably generated during washing of the pulp and thus may also not require an external source). These two liquors help neutralize the vessel contents and bring them to a higher pH of, e.g., 8.5 to 9.0. At the same time, the white and black liquors (or other fluids) displace hydrolysate containing carbohydrate material that is either taken to a recovery boiler (not shown) for burning or to the system where recovery of sugars and other organic materials takes place. The white and black liquors may enter the vessels of the vertical pressure vessel system 410 at the temperatures that they are generated, for example at 95° C. for white liquor and 85° C. for black liquor, and the contents of the vessels will end up at the temperature of approximately 85° C. thus allowing for discharge of hydrolysate and pre-hydrolyzed chips or other fiber-containing organic matter at atmospheric pressure.

Preferably, all or substantially all of the white liquor used in the neutralization process is generated locally at the same mill in, e.g., its recausticizing facility, thus avoiding the need for an external source of typically caustic alkali media. Likewise, preferably all or substantially all the black liquor used in the neutralization process is generated locally at the same mill as part of, e.g., the process of washing the pulp downstream, thus avoiding the need for an external source of typically caustic alkali media. The system of FIG. 4 may therefore be very economically employed, reducing or eliminating the need to purchase externally generated chemicals like sulfuric acid and caustic soda or other fluids. All of the chemicals and steam needed for operating the pre-hydrolysis and neutralization stages may be provided within the mill itself, thereby allowing substantial cost savings and related advantages such as a steady supply and greater quality control.

Figure 6:
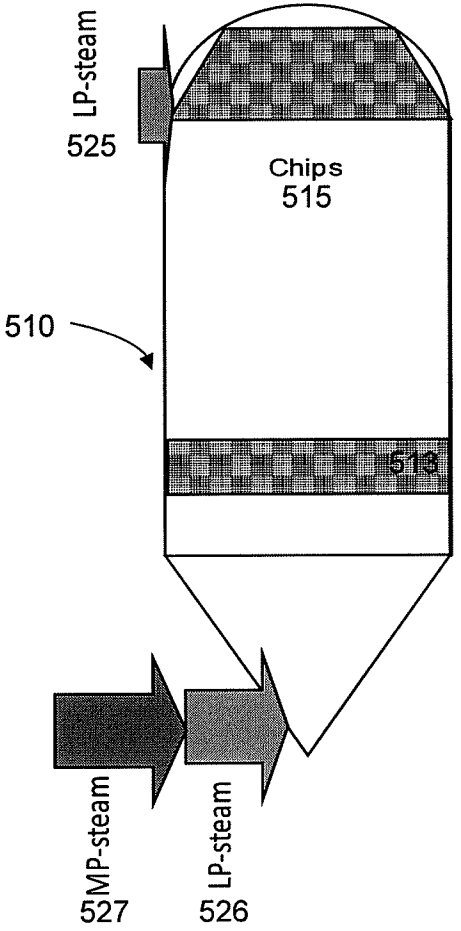
FIGS. 5, 6, 7A-7C and 8 are cross-sectional diagrams of a vertical pressure vessel or other reaction vessel illustrating an example of liquor and material levels as may be used in connection with pre-hydrolysis and neutralization processes carried out in a kraft process for making dissolving pulp described in relation to FIGS. 2 and 4.
Figure 5:
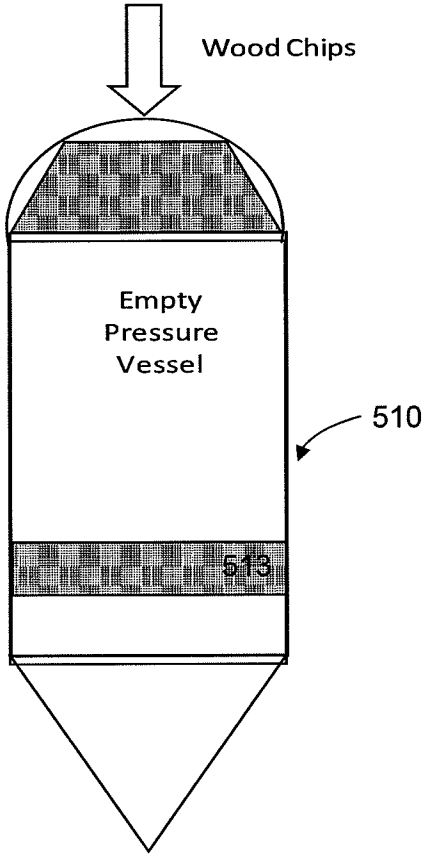

Examples of pre-hydrolysis and neutralization processes are illustrated in certain aspects in FIGS. 5-8, although a variety of other techniques and/or parameters for pre-hydrolysis or neutralization may be used instead. As shown in FIG. 5, an empty vertical pressure vessel 510 representing one of the vessels in the vertical pressure vessel system (such as 410 in FIG. 4) is filled with wood chips 507 or other organic fiber-containing material. The vertical pressure vessel 510 may be outfitted with internal screens (an example of which is illustrated as 513 in FIG. 5) and other features as are conventionally available. As illustrated in FIG. 6, low pressure (LP-) steam 525 may be introduced to facilitate packing of the wood chips 515 or other material. As also illustrated in FIG. 6, pre-heating and pre-hydrolysis may be carried out in batch mode within the vertical pressure vessel 510 by heating using both LP-steam 525 and a medium pressure (MP-) steam 527, so as to bring the contents to a suitable temperature of, e.g., 165° C. and maintain them at the selected temperature. As alluded to earlier, in other techniques, different temperatures and heating times may be used depending upon the particulars of the equipment and the nature of the wood chips or other organic materials being heated.

Figures 7A, 7B, 7C:
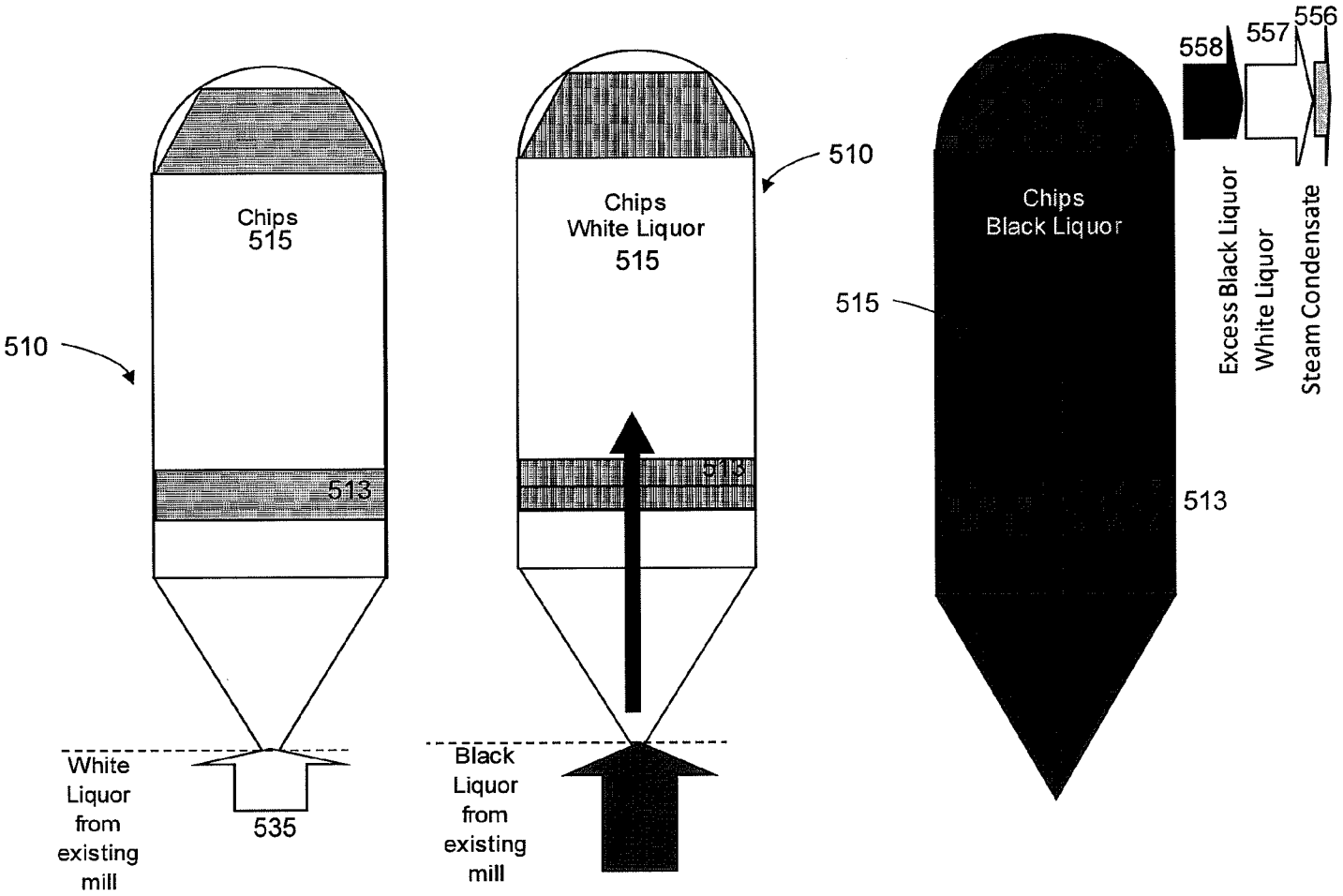
Figure 8:
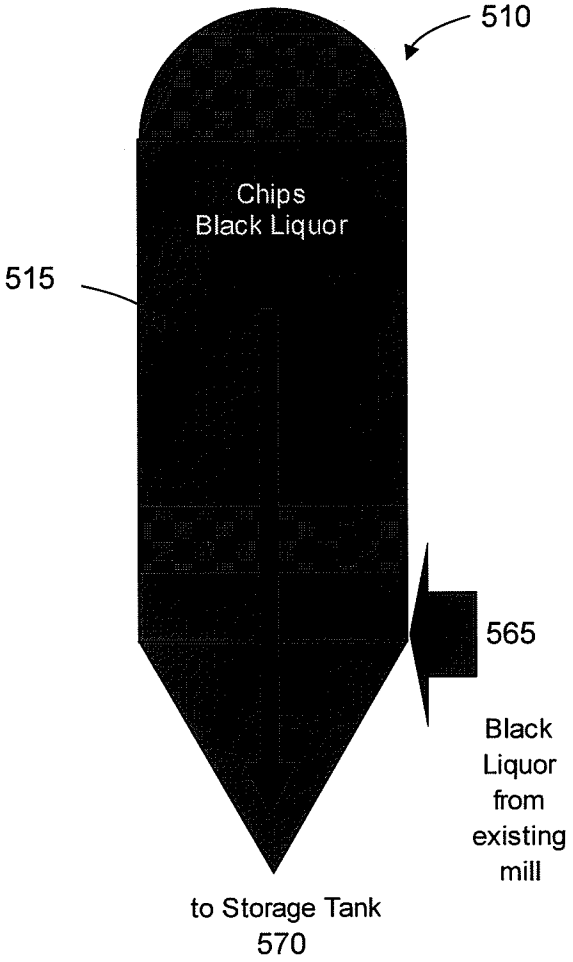

Following pre-hydrolysis, as now shown in FIGS. 7A-7C, a neutralization process takes place through the addition of various alkaline fluids or liquors. In this particular example, a white liquor 535 (which is preferably generated in the mill itself, for example in the mill's recausticizing plant) may be introduced into the vertical pressure vessel 510 as shown in FIG. 7A, followed by a black liquor 545 (which is also preferably generated in the mill itself, for example during washing of the pulp) as shown in FIG. 7B. These liquors, as noted, help neutralize the vessel contents and bring them to a higher pH. At the same time, as shown in FIG. 7C, upon completion of neutralization the hydrolysate, equal in volume to the mixture of steam condensate 556 plus white liquor 557 plus excess black liquor 558, is discharged from the vertical pressure vessel 510. As neutralization is completed, as shown in FIG. 8, additional black liquor 565 is added to the vertical pressure vessel 510, to facilitate the discharge of pre-hydrolyzed chips 515 or other fiber-containing organic matter at atmospheric pressure to a downstream storage tank 570 or other destination.

After pre-hydrolysis and neutralization have been performed with the vertical pressure vessel system 410, the pre-hydrolyzed wood chips or other material may then be extracted from the base of the pressure vessel(s) 410 along line 412 by, e.g., releasing a valve, and transferred to a storage tank 415 via pump 413 for temporary storage. This allows for a continuous supply of hydrolyzed wood chips or other material for cooking. As the temperature of the hydrolyzed wood chips or other material is preferably around 85° C., the storage tank 415 need not be configured as a pressure vessel.

The pre-hydrolyzed wood chips or other material are then supplied as needed to the continuous digester 420, using another pump 416 and, in this example, the same high-pressure feeder 474 as used to transfer pre-treated wood chips or other material from the storage tank 476 to the continuous digester 420 when making paper grade pulp. The high pressure feeder 474 feeds the wood chips or other fiber-containing matter from the storage tank 415 to the inlet 428 at the top of the continuous digester 420, which may be outfitted with, for example, a separator 381 which may be an inverted top separator or other type of separator.

As previously described in connection with FIG. 2, while the system shown in FIG. 4 is configured such that pre-hydrolyzed chips or other fiber-containing material are temporarily stored in a storage tank 415, in other embodiments it may be possible to supply the continuous digester 420 directly from the vertical pressure vessel system 410 using, e.g., one or more valves to switch between different pressure vessels in the vertical pressure vessel system 410, thereby ensuring a continuous supply of material to the continuous digester 420. Alternatively, the continuous digester 420 may be selectively fed from the storage tank 415 or directly from one or more vessels of the vertical pressure vessel system 410, using one or more valves to control the input to the continuous digester 420.

As the pre-hydrolyzed chip mixture is fed to the continuous digester 420, white liquor or other cooking liquors (depending upon the particular process) may be added in the proximity of the chips to form a slurry. Excess liquors may be extracted and re-circulated via outlet 429 and pump 477 back to the high pressure feeder 474.

The slurry formed in part of the pre-hydrolyzed chip mixture is then cooked in the continuous digester 420 according to any relevant technique for making a brownstock for dissolving pulp, and more specifically may be cooked according to a kraft process using temperatures, time settings, and other parameters as would be necessary to produce a brownstock for dissolving pulp. The slurry gradually descends from the top of the continuous digester 420 to the bottom, traversing through different cooking zones or chambers each of which corresponds to a particular stage of the cooking process. To make dissolving pulp, the operator selects the appropriate temperatures, time settings and other parameters for the continuous digester 420, which may differ in at least some respects from the specific parameters used to make paper grade pulp or may be optimized for a particular grade of pulp. The continuous digester 420 may use, for example, a counter-cooking or modified counter-cooking technique, or any other cooking technique. After one or more runs of dissolving pulp are completed, the operator may return the parameters to those appropriate for making paper grade pulp, and the system may then be immediately re-configured to make paper grade pulp using the horizontal steaming vessel 475, holding tank 476, and other equipment used for that process.

Paper grade pulp is normally cooked to a Kappa number of around 18, but for dissolving pulp a much lower Kappa number of around 6.5 is desirable. Normally, switching between cooking of paper grade pulp and dissolving pulp will not require major changes in the cooking conditions or parameters, with the most significant difference perhaps being modest reduction in the white liquor sulphidity—for example, from around 32% for paper grade pulp to around 28% for dissolving pulp.

After cooking with the continuous digester 420 has been completed, the resulting brownstock 422 is passed down to the next processing stage, which as illustrated in FIG. 2 may be a washing and oxygen delignification process 230 but in some cases may be a bleaching process 240.

Figure 9:
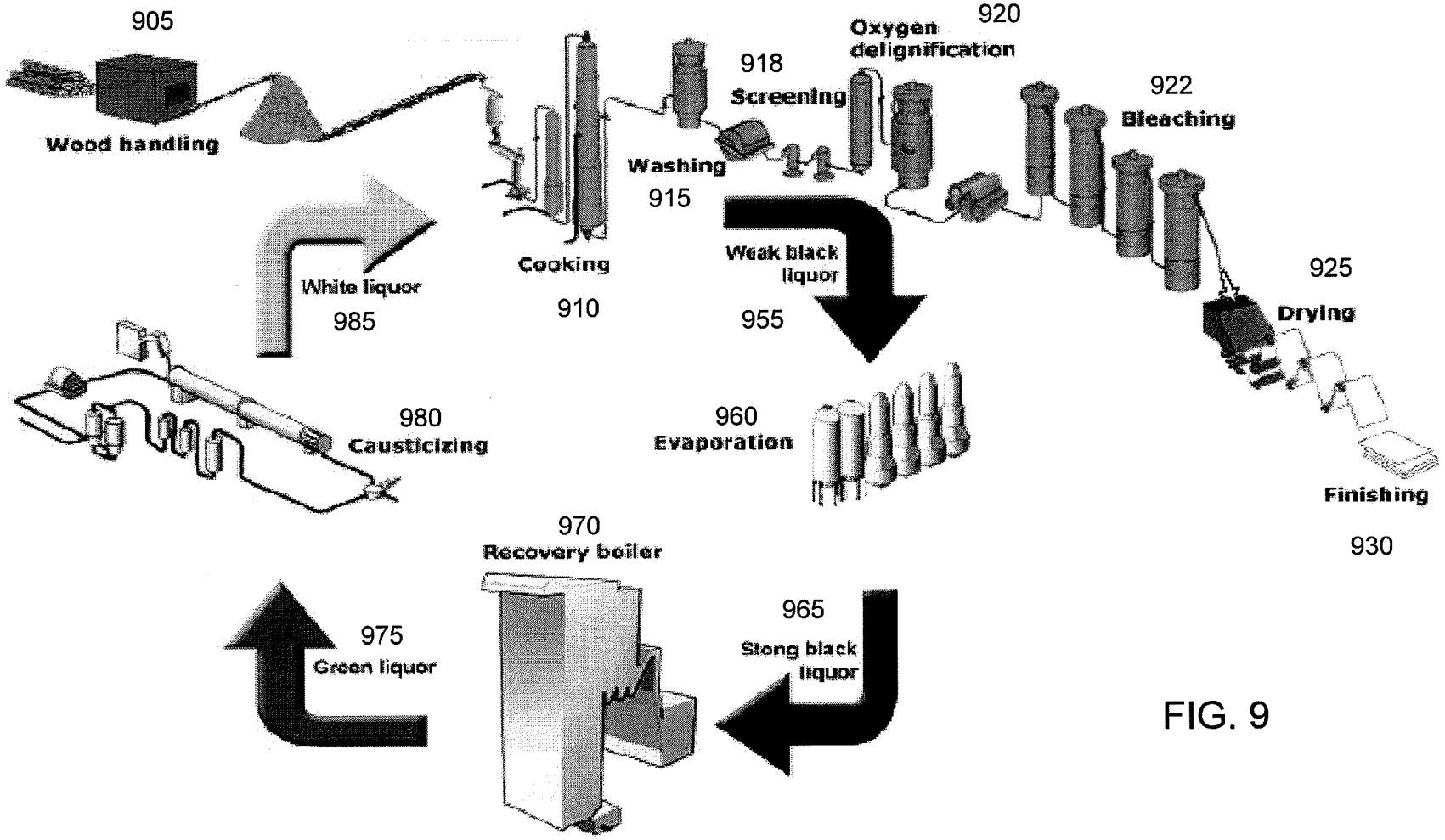
FIGS. 9 and 10 are process flow diagrams for pulp manufacturing illustrating selected process stages, during which various liquors may be produced and tapped for use in, among other things, a neutralization process carried out when making dissolving pulp.
Figure 10:
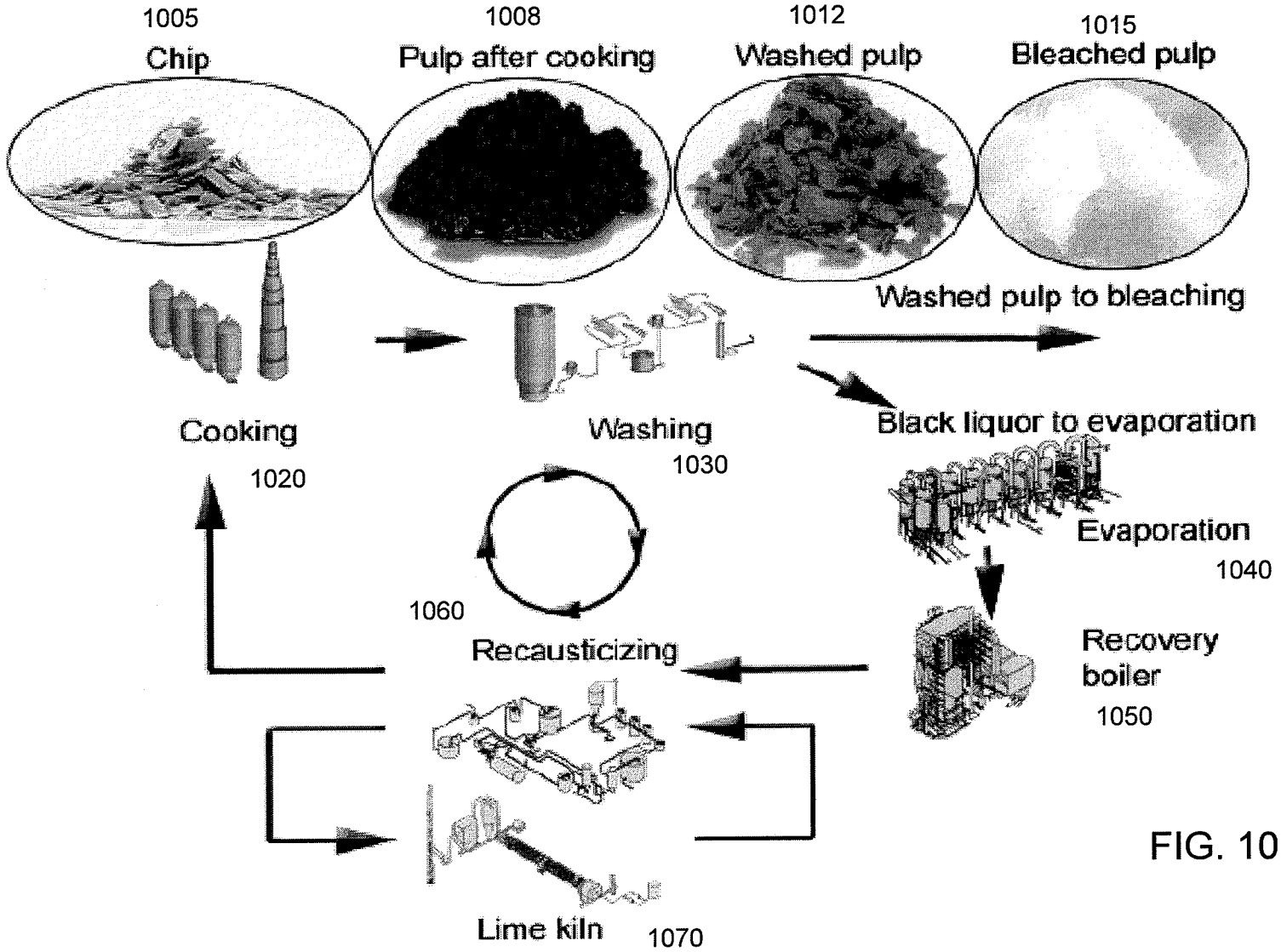

FIGS. 9 and 10 are process flow diagrams for pulp manufacturing and related processes illustrating various operations and stages, during which various liquors may be produced and tapped for use in, among other things, a neutralization process carried out when making dissolving pulp in the previously described embodiments. FIG. 9 shows wood chips or other fiber-containing material 905 being fed to a processing/cooking stage 910 which, in the case of a system such as illustrated in FIG. 2 or 4, may include both a vertical pressure vessel system operated in batch mode (for pre-hydrolysis and neutralization) and a continuous digester for continuous kraft cooking. The processing/cooking stage 910 is followed by a washing stage 915 (which may include horizontal belt washers, rotary drum washers, vacuum filters, wash presses, compaction baffle filters, atmospheric diffusers or pressure diffusers, or other washing means), a screening stage 918, and oxygen delignification process 920 as previously described. The delignified pulp may continue to a downstream bleaching unit 922 for further delignification and brightening, and then later to a pulp drying station 925 and ultimately is formed into bales or other similar pulp products 930.

In parallel with these processes, a weak black liquor 955 is extracted during the washing stage and may be provided to an evaporation unit 960 for concentrating the weak black liquor into a strong black liquor 955. In the systems of FIG. 2 or 4, such weak black liquor 955 or strong black liquor 965 may be used in connection with the neutralization process when making dissolving pulp. The strong black liquor 965 is typically provided to a recovery boiler 970, which produces a green liquor 975 that is sent for causticizing in a recausticizing plant 980. The recausticizing plant 980 may, among other things, produce a white liquor 985 that can be used in the cooking process as well as in the neutralization process when making dissolving pulp.

FIG. 10 shows selected portions of the above process in a simplified manner, as well as some additional aspects. As illustrated in FIG. 10, wood chips 1005 or other fiber-containing material are provided to a processing/cooking stage 1020, and the brownstock 1008 after cooking is then conveyed downstream to, among other things, a washing stage 1030 (as well as screening and oxygen delignification). The washed and delignified pulp 1012 is conveyed to a bleaching stage to produce a bleached pulp 1015. During the washing stage, a weak black liquor is produced as a by-product and provided to one or more evaporators 1040 to concentrate the weak black liquor into a strong black liquor, which is provided to the recovery boiler 1050. A green liquor output from the recovery boiler 1050 is provided to a recausticizing plant 1070 that may include a lime kiln and other equipment as known in the art. The recausticizing plant 1070, as noted, produces a white liquor that may be used for cooking and, in the systems of FIGS. 2 and 4, for neutralization in a vertical pressure vessel system.

In various embodiments, the weak or strong black liquors and the white liquor produced in a mill's washing equipment, evaporators, and/or recausticizing plant, or other facilities, may be utilized in connection with the neutralization carried out to make dissolving pulp in systems such as illustrated in FIGS. 2 and 4. This use of existing liquors and fluids may result in substantial economies when producing dissolving pulp according to the techniques described herein.

In one aspect, a flexible system is provided for making different grades or qualities of pulp in a cost-efficient manner. The system can use the same continuous digester to selectively carry out kraft cooking of paper grade pulp or dissolving pulp, depending upon the needs of the facility. A vertical pressure vessel system (e.g., one or more pressurized reaction vessels) may be used in a batch mode for pre-hydrolysis and neutralization when the system is producing dissolving pulp, but is otherwise generally not utilized in connection with making paper grade pulp. A feeder and pre-treatment system may be employed to selectively supply organic fiber-containing material to the vertical pressure vessel system when making dissolving pulp and to the continuous digester when making paper grade pulp.

In another aspect, a method for selectively producing pulp of different grades using a continuous digester is provided, comprising the steps of selectively supplying organic fiber-containing material to a vertical pressure vessel system (e.g., one or more pressurized reaction vessels) when making dissolving pulp and to a continuous digester when making paper grade pulp; performing pre-hydrolysis and neutralization in batch mode when organic fiber-containing material is supplied to the vertical pressure vessel system in connection with making dissolving pulp; providing treated chips from the vertical pressure vessel system to the continuous digester when making dissolving pulp; and selectively performing kraft cooking with the continuous digester of either the treated pulp to produce a brownstock for dissolving pulp or the organic fiber-containing material to produce a brownstock for paper grade pulp.

The foregoing system and method may be well suited to modifying or retrofitting existing paper grade pulp mills with minimal additional cost so that they can also produce dissolving pulp upon demand. There is no inherent limitation as to the type of continuous digester that may be used with the system, or the type of vertical pressure vessel system or batch-mode reaction vessel(s) that may be used for the pre-hydrolysis and neutralization stages when making dissolving pulp. In addition, because the hydrolysate generated during pre-hydrolysis and neutralization in the vertical pressure vessel is kept separate and apart from the contents of the continuous digester, the system may avoid scaling or gunking associated with prior processes, avoiding the need to perform costly and frequent system shut-downs for cleaning.

An addition benefit that may be realized according to particular embodiments as disclosed herein is a high degree of efficiency when making dissolving pulp, as the white liquor and black liquor used in the neutralization process may be, and is preferably, directly provided from the same mill, as opposed to requiring an external source. This can result in substantial cost savings as compared with, for example, attempting to produce dissolving pulp with solely a continuous digester system.

Embodiments of the invention are well suited for retrofitting paper pulp mills to provide an additional capability to produce dissolving pulp. A paper pulp mill can, once retrofitted, be employed to produce exclusively dissolving pulp, if such operation is desired.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A system for selectively producing pulp of different grades, comprising:

a continuous digester operable to selectively carry out kraft cooking of paper grade pulp or dissolving pulp;

a vertical pressure vessel upstream from said continuous digester and coupled to the continuous digester in a manner to allow contents of the vertical pressure vessel to be conveyed to the continuous digester for kraft cooking, said vertical pressure vessel operable to perform pre-hydrolysis and neutralization in a batch mode when the system is producing dissolving pulp but not utilized in connection with making paper grade pulp;

a source of neutralization fluid selectively connected to an intake of the vertical pressure vessel;

a source of cooking fluids suitable for kraft cooking selectively connected to an intake of the continuous digester;

a feeder and pre-treatment system operable to selectively supply organic fiber-containing material to the vertical pressure vessel when making dissolving pulp and to the continuous digester when making paper grade pulp; and a storage tank interposed between the vertical pressure vessel and the continuous digester for storing treated chips that have been subject to pre-hydrolysis and neutralization in the vertical pressure vessel, to facilitate a steady flow of the treated chips to the continuous digester when making dissolving pulp.

2. The system of claim 1, wherein said vertical pressure vessel is provided as a retrofit addition to the continuous digester at an existing mill, and wherein the feeder and pre-treatment system diverts a normal flow of the organic fiber-containing material from the continuous digester to said vertical pressure vessel for pre-hydrolysis and neutralization prior to being conveyed to said continuous digester when making dissolving pulp.

3. The system of claim 1, wherein said feeder and pre-treatment system further comprises a chip feeder and conveyance system whereby organic fiber-containing material is selectively provided either to the continuous digester when making paper grade pulp or first to the vertical pressure vessel when making dissolving grade pulp.

4. The system of claim 3, wherein said continuous digester is selectively operated for a time and at a temperature suitable to make dissolving grade pulp when it is cooking fiber-containing material received from said vertical pressure vessel after pre-hydrolysis and neutralization, and for a time and at a temperature suitable to make paper grade pulp at other times.

5. The system of claim 4, further comprising, downstream from said continuous digester, a washing and screening station, a bleaching station, and a pulp drying station.

6. The system of claim 1, wherein said continuous digester is a single-vessel type continuous digester.

7. The system of claim 1, wherein said continuous digester is a multi-vessel type continuous digester.

8. The system of claim 1, wherein said vertical pressure vessel is steam pressurized in connection with a pre-hydrolysis step, and is filled with a combination of white liquor and black liquor in connection with a neutralization step.

9. The system of claim 8, wherein substantially all the white liquor and the black liquor used for neutralization are respectively produced in a mill's recausticizing facility and pulp-washing facility.

10. The system of claim 1, further comprising a common recovery boiler utilized both when making paper grade pulp and dissolving grade pulp, wherein the operational capacity of the vertical pressure vessel system corresponds to an operational capacity of the recovery boiler.

11. A system for selectively producing pulp of different grades, comprising:

a continuous digester operable to selectively carry out kraft cooking of paper grade pulp or dissolving pulp;

a vertical pressure vessel system comprising one or more vertical pressure vessels upstream from said continuous digester and coupled to the continuous digester in a manner to allow contents of the one or more vertical pressure vessels to be conveyed to the continuous digester for kraft cooking, said one or more vertical pressure vessels operable to perform pre-hydrolysis and neutralization in a batch mode when the system is producing dissolving pulp but not utilized in connection with making paper grade pulp, and said vertical pressure vessel system having a capacity matched to that of the continuous digester, sufficient to provide pre-processed pulp to the continuous digester without interruption when making dissolving pulp;

a source of neutralization fluid selectively connected to an intake of each of the vertical pressure vessels; and a feeder and pre-treatment system operable to selectively supply organic fiber-containing material to the one or more vertical pressure vessels when making dissolving pulp and to the continuous digester when making paper grade pulp.

* * * * *